US008777362B2

(12) United States Patent
Kobayashi

(10) Patent No.: US 8,777,362 B2
(45) Date of Patent: Jul. 15, 2014

(54) DATA GENERATION APPARATUS, DATA GENERATION METHOD, AND PROGRAM

(75) Inventor: Hideyuki Kobayashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 13/487,598

(22) Filed: Jun. 4, 2012

(65) Prior Publication Data

US 2012/0313993 A1 Dec. 13, 2012

(30) Foreign Application Priority Data

Jun. 9, 2011 (JP) ..... 2011-129156

(51) Int. Cl.

| | |
|---|---|
| ***B41J 29/38*** | (2006.01) |
| ***B41J 11/00*** | (2006.01) |
| ***B41J 11/42*** | (2006.01) |
| *B41J 15/04* | (2006.01) |

(52) U.S. Cl.

CPC ..... *B41J 11/008* (2013.01); *B41J 11/42* (2013.01); *B41J 15/04* (2013.01)

USPC ..... 347/16

(58) Field of Classification Search

CPC ..... B41J 29/38; B41J 11/008; B41J 11/42; B41J 15/04

USPC ..... 347/16, 19, 101, 104

See application file for complete search history.

(56) References Cited

U.S. PATENT DOCUMENTS 8,366,228 B2 * 2/2013 Yoshida ..... 347/15

FOREIGN PATENT DOCUMENTS

JP 8-85242 A 4/1996

* cited by examiner

*Primary Examiner* — An Do

(74) *Attorney, Agent, or Firm* — Canon USA Inc IP Division

(57) ABSTRACT

A data generation apparatus for generating image data used for printing an image on a print medium by using a printing apparatus having an adjusting function for increasing and/or decreasing a conveyance amount by which the print medium is conveyed in a conveyance direction with respect to a standard conveyance amount used when an image with a specified size is printed includes an acquisition unit configured to acquire an adjustment amount of the conveyance amount, and a changing unit configured to change a size of the image data corresponding to the conveyance direction of the print medium according to the adjustment amount acquired by the acquisition unit.

12 Claims, 9 Drawing Sheets

DATA GENERATION APPARATUS, DATA GENERATION METHOD, AND PROGRAM

BACKGROUND OF THE INVENTION

1. Field of the Invention

The present invention relates to a data generation apparatus, a data generation method, and a program which generate data used for printing an image on a print medium.

2. Description of the Related Art

A serial scan inkjet printer may generate unevenness between bands through each of which a print head passes in one scanning. The unevenness results from darkening between the bands caused if a print medium is the one into which ink tends to bleed or, on the contrary, lighting between the bands caused if the print medium is the one into which ink hardly bleeds, even when the print medium is conveyed according to a theoretical design quantity. Japanese Patent Application Laid-Open No. 08-85242 discusses a solution to such a problem in such a way that a test pattern is printed to adjust a conveyance amount of the print medium, thus reducing the unevenness.

As discussed in Japanese Patent Application Laid-Open No. 08-85242, if the conveyance amount of the print medium for each scan is adjusted by increasing or decreasing the conveyance amount with respect to a reference conveyance amount, a print range of an image printed on the print medium may be made longer or shorter in the conveyance direction. This causes a problem that, if the print range is made longer, an image to be printed does not fall within a predetermined range or, if the print range is made shorter, an unintended margin is produced in the predetermined range.

SUMMARY OF THE INVENTION

According to an aspect of the present invention, a data generation apparatus for generating image data used for printing an image on a print medium by using a printing apparatus having an adjusting function for increasing and/or decreasing a conveyance amount by which the print medium is conveyed in a conveyance direction with respect to a standard conveyance amount used when an image with a specified size is printed includes an acquisition unit configured to acquire an adjustment amount of the conveyance amount, and a changing unit configured to change a size of the image data corresponding to the conveyance direction of the print medium according to the adjustment amount acquired by the acquisition unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
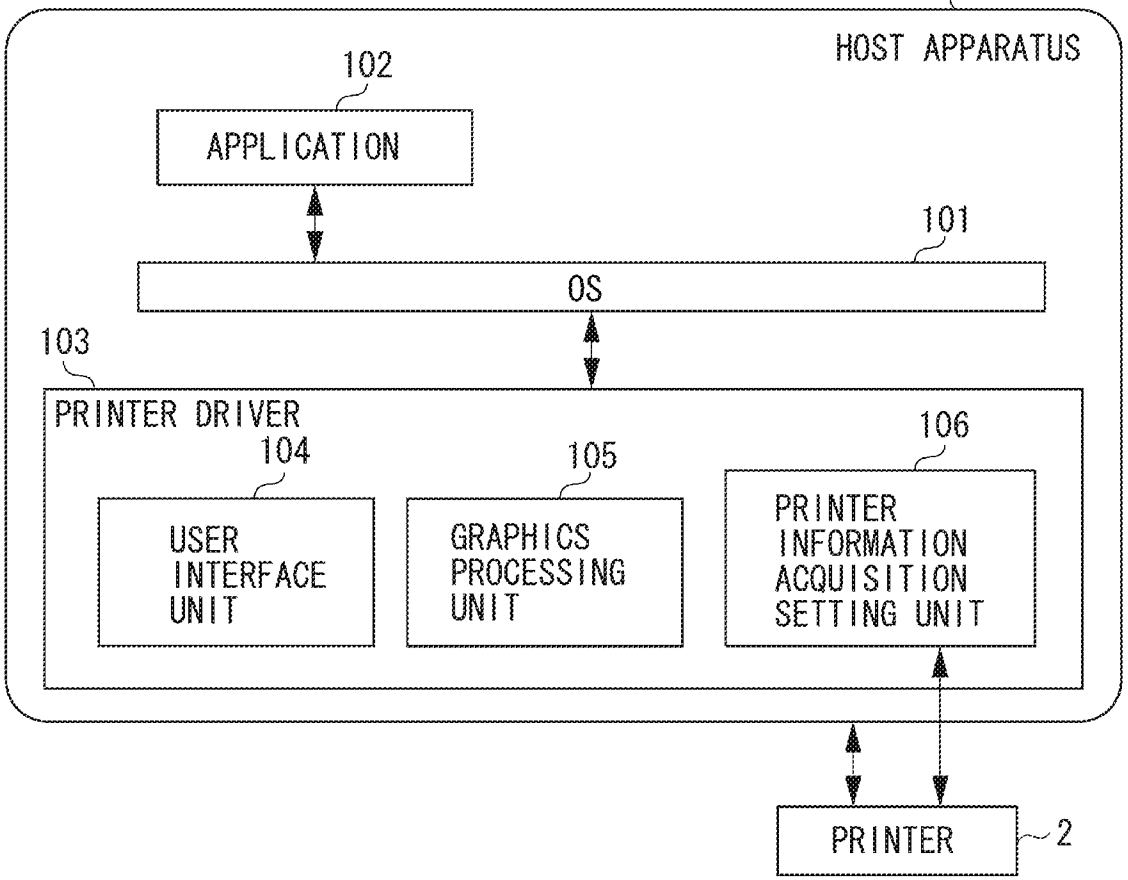
FIGS. 1A and 1B are schematic block diagrams illustrating a configuration of a printing system to which the present invention can be applied.

FIG. 1A is a block diagram illustrating a configuration of a printing system according to an exemplary embodiment. The printing system according to the present exemplary embodiment includes a host apparatus 1, such as a personal computer (PC), and a printer (printing apparatus) 2 connected to the host apparatus 1.

On the host apparatus 1 there are installed an operating system (hereinafter referred to as OS) 101, a printer driver 103 serving as software for controlling the printer 2, and an application 102 for creating various types of documents. On the host apparatus 1, the OS 101 and the printer driver 103 operate to print various types of documents created by the application 102. The printer driver 103 includes the following three function units: a user interface unit 104 for receiving input from a user; a graphics processing unit 105 for generating print data to be transmitted to the printer 2; and a printer information acquisition setting unit 106. The graphics processing unit 105 generates print image data (image data) corresponding to an image to be printed and page description language (PDL) data in which additional information, such as the type and size of a print medium, is described in the PDL. The printer information acquisition setting unit 106 acquires information about the width of the print medium loaded on the printer 2 and various pieces of information about a printer, such as a current state of the printer 2, and transmits such information to the printer 2.

Figure 1B:
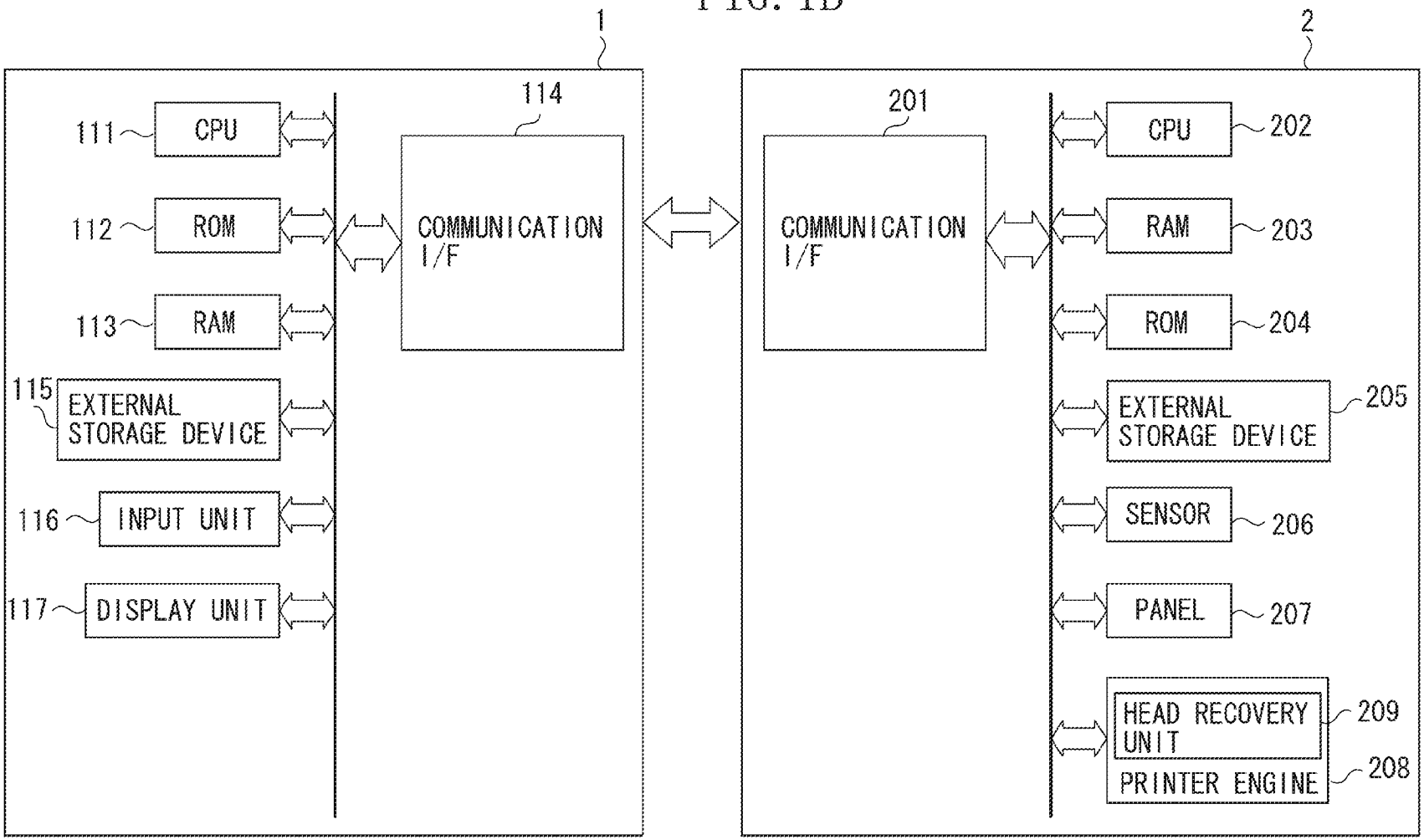

FIG. 1B is a block diagram illustrating a configuration of the host apparatus 1 and the printer 2. In FIG. 1B, a central processing unit (CPU) 111 performs various control operations of the entire host apparatus. A read only memory (ROM) 112 stores an initialization program executed by the CPU 111 when the host apparatus is booted up and various data. A random access memory (RAM) 113 is used as main memory and a work area for the CPU 111. An external storage device 115 is formed of a hard disk drive (HDD), for example, and stores various programs. Programs for realizing the processing indicated by a flow chart described below are loaded on the RAM 113 by the external storage device 115 such as an HDD. An input unit 116 includes a keyboard and a mouse and inputs various instructions to the CPU 111. A display unit 117 formed of a liquid crystal display (LCD) or a cathode ray tube (CRT) performs various displays by the control of the CPU 111. Communication is performed with a peripheral apparatus, such as the printer 2, via a communication interface 114.

The printer 2 is connected to the host apparatus 1 via a communication interface 201. A central processing unit (CPU) 202 performs various control operations of the entire printer 2. A random access memory (RAM) 203 stores an image color conversion table and a profile used for image processing. A read only memory (ROM) 204 stores programs for controlling the printer 2, programs for the image processing, and information about conveyance adjustment amounts described below. An external storage device 205, such as a hard disk drive (HDD), stores print data and management information thereof. A sensor 206 is capable of detecting the insertion of a cassette, the size of a print medium, and the types of paper (the types of a print medium) and reading information about a bar code. An operation panel 207 includes several keys for setting the printer 2 and a display unit for displaying the status of the printer 2. A printer engine 208 controls a print head and a motor for driving the print head based on the print data transmitted from the host apparatus 1. A head recovery unit 209 performs recovery operations such as suctioning ink from the print head and wiping using a print head recovery motor and then performs capping.

Figure 2A:
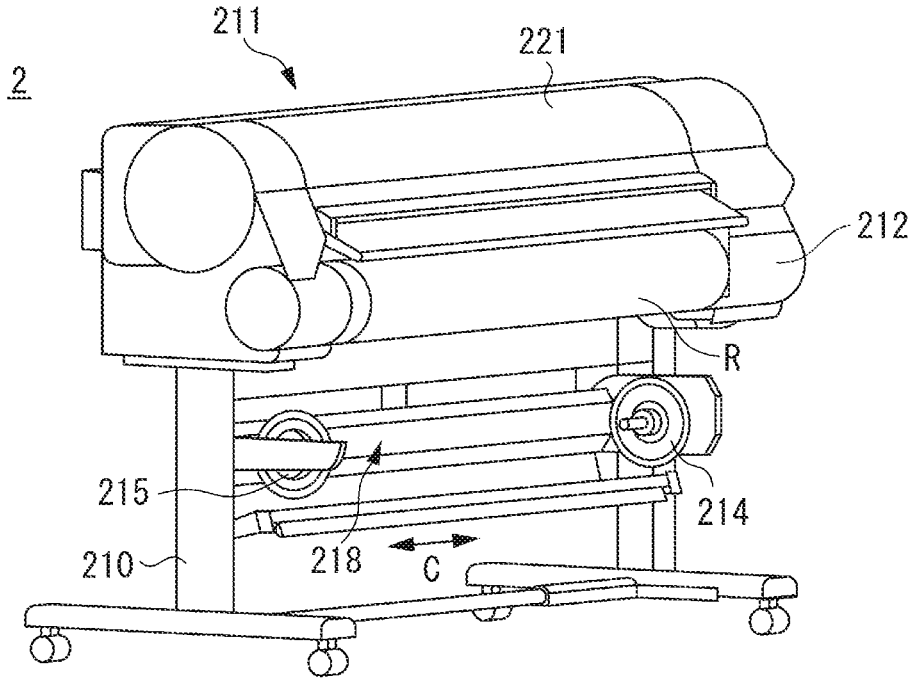
FIGS. 2A and 2B are outer perspective views of a printing apparatus to which the present invention can be applied.

FIG. 2A illustrates a schematic perspective view of the printer 2. The printer is configured such that an apparatus main body (a main body part) 211 is mounted on the upper portion of a stand 210. A roll-shaped print medium (roll paper) R wound around a paper tube is set on the front side of the main body part 211. The main body part 211 is provided with a paper feeding mechanism 212 including a paper feeding unit for feeding (conveying) paper to a print position while unwinding the print medium R and a rewind unit for rewinding the unwound print medium R. An image is printed on the print medium R unwound from the paper feeding mechanism 212 at the print position while the print medium R is being conveyed along a U-turn path and the print medium R is discharged from the front side of the main body part 211.

A take-up device for taking up the print medium R on which the image is printed by the main body part 211 is provided on the lower portion of the main body part 211. The take-up device causes a paper tube (not illustrated) held between a take-up drive unit 214 and a take-up movable unit 215 to take up the print medium R sent from the main body part 211. The take-up drive unit 214 includes a motor (not illustrated) for rotating the paper tube based on a signal from an encoder. The take-up movable unit 215 is movable in the width direction indicated by a double-headed arrow C and can be moved by a user according to the length of the held paper tube (the width of the print medium R).

Figure 2B:
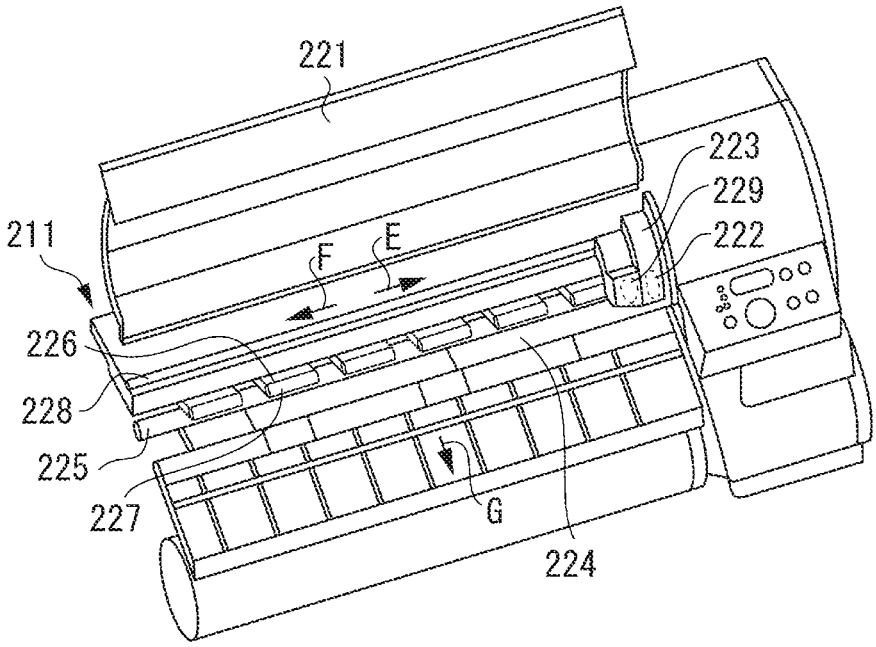

FIG. 2B illustrates a perspective view of the main body part 211. An opening/closing cover 221 is provided on the upper portion of the main body part 211. Opening the opening/closing cover 221 can access an internal mechanism. A carriage 223, which is reciprocally movable in the width direction of the print medium R and on which a print head 222 is mounted, is provided on the main body part 211. A platen 224 for guiding and supporting the print medium R on which the image is printed by the print head 222 is arranged at a position opposite the print head 222. A conveyance roller 225 for conveying the print medium R (feeding paper) is arranged at the upstream of the conveyance direction of the platen 224 (in the present exemplary embodiment, a position by the print medium R on the paper tube set on the paper feeding mechanism 212 on the U-turn conveyance path of the main body part 211). A plurality of pinch rollers 227 pivoted on a roller holder 226 is pressed against the conveyance roller 225 by an elastic force to provide a conveyance force for the print medium R sandwiched therebetween.

In the printer 2, the print head 222 ejects ink onto the print medium R based on the print data to print an image while the carriage 223 is being moved (main scanning) in the directions indicated by arrows E and F along a rail 228. Printing corresponding to one line and the conveyance of the print medium R (feeding paper) in the direction indicated by an arrow G at a predetermined pitch are alternately repeated in synchronization with the movement of the carriage 223 to print the image on the print medium R.

The carriage 223 is equipped with a cutter unit 229 for cutting the print medium R. The carriage 223 is moved in the main scanning direction and the cutter unit 229 abuts on a projection member to cause a cutting edge to appear from the cutter unit 229. In this state, the carriage 223 is moved in the directions indicated by the arrows E and F to cut the print medium R. There is a projection similar to the projection member on the side opposite to the direction in which the carriage 223 is moved. The cutting edge of the cutter unit 229 is retracted by the cutting edge abutting on the projection. A sensor unit (not illustrated) is attached to the carriage 223 and capable of detecting the position of an edge of the print medium R. The sensor unit provided with various light-emitting diodes (LED) can not only measure edges and thickness of a large number of print media, but also can calculate the width of the print medium R from a difference in information between the positions of the left and right edges of the print medium R. If the left and right edges of the print medium R are not uniform, the edges can be identified by the user inputting the width of the medium at the time of attaching the medium. Apart from the sensor unit, a medium presence sensor (not illustrated) is provided on the platen 224 on the upstream side of the conveyance direction. The medium presence sensor is an optical sensor composed of a light emitting element and a light sensitive element and detects whether the print medium R exists in such a manner that the light emitting element emits light and the light sensitive element receives reflected light.

The following describes procedures for setting a print condition when the user prints an image. The user produces any document and image using the application 102 and issues instructions for print from the menus of the application 102 to start a print dialog. In general, pressing a property button in the print dialog of the application 102 allows confirming or changing the setting of the selected printer driver 103.

Figure 3:
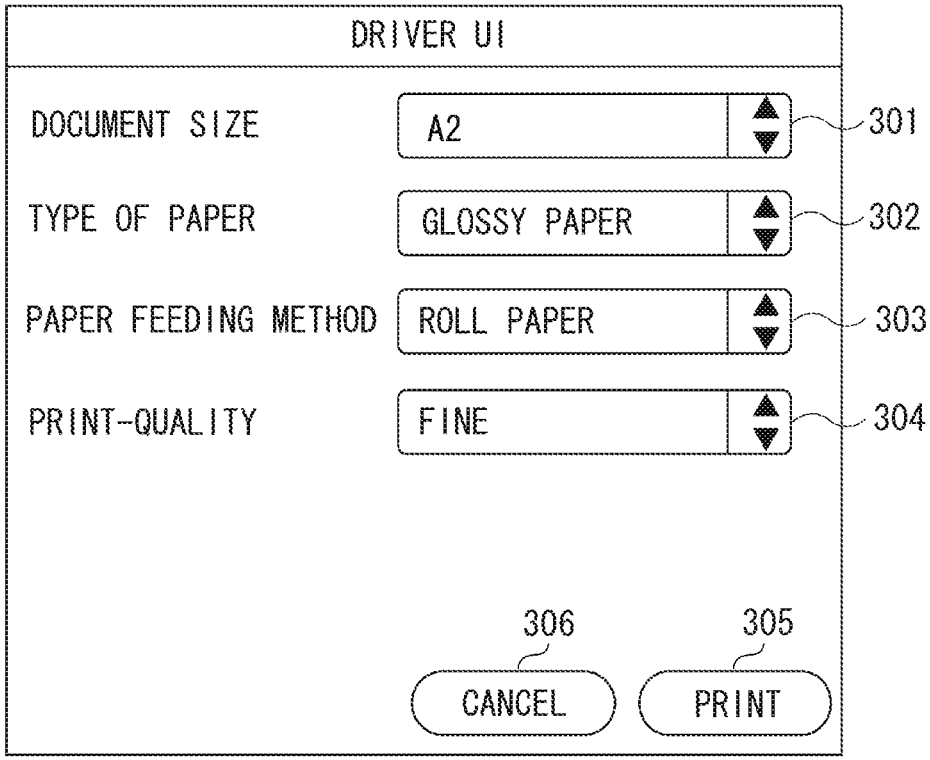
FIG. 3 illustrates an example of a setting screen of a printer driver according to an exemplary embodiment of the present invention.

FIG. 3 illustrates the user interface of a setting screen displayed by the printer driver 103. The user interface includes a document-size list box 301, a paper-type list box 302, a paper feeding method list box 303, and a print-quality list box 304. The user interface also includes a print button 305 and a cancel button 306. The user can set the size of a document (a print medium) by the document-size list box 301. In the printer of the present exemplary embodiment, the printed roll paper is cut by the cutter unit 229 to allow an image to be printed on the print medium with a predetermined size. In FIG. 3, a case is illustrated where A2 is set as the size of a document. The types of paper (the types of a print medium) can be set in the paper-type list box 302. In FIG. 3, a case is illustrated where glossy paper is set. A paper feeding method in printing can be set in the paper feeding method list box 303. In FIG. 3, a case is illustrated where roll paper is set. Print quality in printing an image can be set from the list of "quick," "standard," "fine," and others in the print-quality list box 304. Changing the setting changes print resolution, the number of passes in multi-pass print, and carriage speed. In FIG. 3, a case is illustrated where "fine" is set in the print-quality list box 304.

The print button 305 is pressed with the above settings completed to determine the setting of the printer driver 103, finishing the display of the user interface. On the other hand, the cancel button 306 is pressed to make the changed setting ineffective. The initial setting of the printer driver 103 or the previously set contents are used and the display of the user interface in the printer driver 103 is finished. The set contents are described as attribute data of image data to be printed. However, the document size (output paper size) is changed according to conveyance adjustment amounts as described below.

Processing for transmitting print data according to the present exemplary embodiment is described below with reference to a flow chart illustrated in FIG. 6. In step S101, a print dialog is displayed. At this point, the type of the print medium set in the printer driver 103 is acquired from the user interface unit 104. In step S102, the host apparatus 1 acquires the conveyance adjustment amount from the printer 2.

In the present exemplary embodiment, the conveyance amount can be adjusted by the conveyance adjustment amount each time the print head scans. The conveyance adjustment amount is the one that adjusts a conveyance amount to preclude boundary streaks from being generated between bands, for example, and increases or decreases a theoretically designed conveyance amount for each type of the print medium to adjust the conveyance amount. The conveyance adjustment amount can be stored in the memory of the printer 2 in advance for each type of the print medium by the user inputting the conveyance adjustment amount via the input unit 116 of the host apparatus 1 or the operation unit of the printer 2. Alternatively, a test pattern is generated for each type of the print medium when the print medium is first used in the printer 2 and read by a multi-sensor provided on the printer 2 to calculate an adjustment value and store the adjustment value in the memory of the printer 2. The conveyance amount is adjusted by increasing or decreasing the number of pulses for rotating a stepping motor provided for driving the conveyance roller of the printer 2 at a constant interval.

In the present exemplary embodiment, information specifying the conveyance adjustment amount (conveyance adjustment amount information) is formed by "increase or decrease of the number of pulses/adjustment interval." For example, if the number of pulses for the rotation of the stepping motor is incremented by one pulse for each 200 pulses to adjust (increase) the conveyance amount, information indicated as "increase of the number of pulses/adjustment interval 200" is formed as an attribute value.

In the present exemplary embodiment, the conveyance amount per one time is corrected using the conveyance correction amount before adjustment for the purpose of reducing boundary streaks is performed by the conveyance adjustment amount. For example, there is a print medium liable to slip depending on the type of the print medium. Therefore, an actual conveyance amount may deviate from the theoretically designed conveyance amount (standard conveyance amount). For this reason, a conveyance correction amount is provided for each type of the print medium to convey the print medium in accordance with the theoretically designed conveyance amount. Thereby, the conveyance amount is corrected by the conveyance correction amount to enable conveying the print medium in accordance with the theoretically designed standard conveyance amount and, furthermore, the conveyance amount is corrected by using the conveyance correction amount to reduce boundary streaks.

Figure 7:
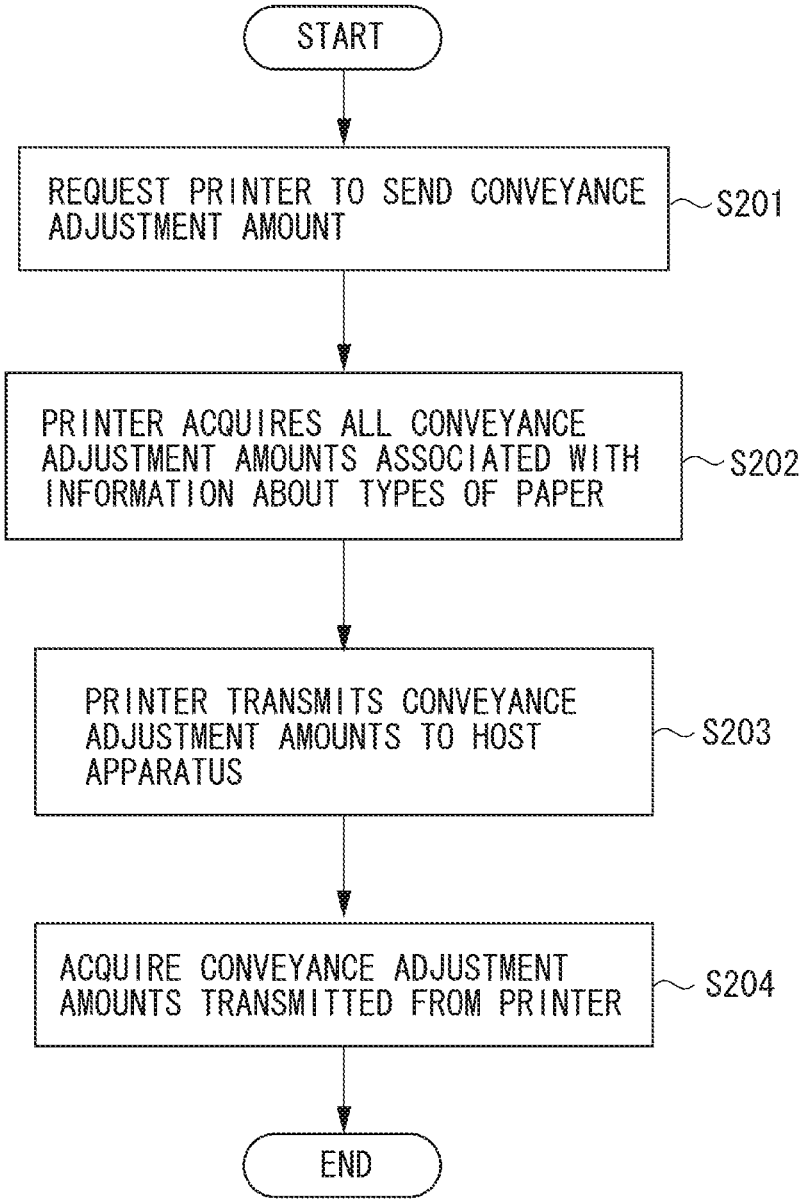
FIG. 7 is a flow chart illustrating processing for acquiring conveyance adjustment amounts according to the exemplary embodiment.

FIG. 7 is a flow chart illustrating processing for acquiring the conveyance adjustment amount in step S102. In step S102, the host apparatus 1 transmits a request for acquiring the conveyance adjustment amounts to the printer 2 via the printer information acquisition setting unit 106. In step S202, the printer 2 acquires the conveyance adjustment amounts stored in the memory. In this step, the printer 2 acquires all the conveyance adjustment amounts that are associated with the respective types of paper (the types of print medium) and stored in the memory. In step S203, the printer 2 transmits the conveyance adjustment amounts set for each type of print medium to the host apparatus 1 via the printer information acquisition setting unit 106. In step S204, the host apparatus 1 acquires the conveyance adjustment amounts received from the printer 2. The host apparatus 1 extracts a conveyance adjustment amount corresponding to the type of a print medium selected by the paper-type list box 302. The processing for acquiring the conveyance adjustment amount is completed.

Figure 6:
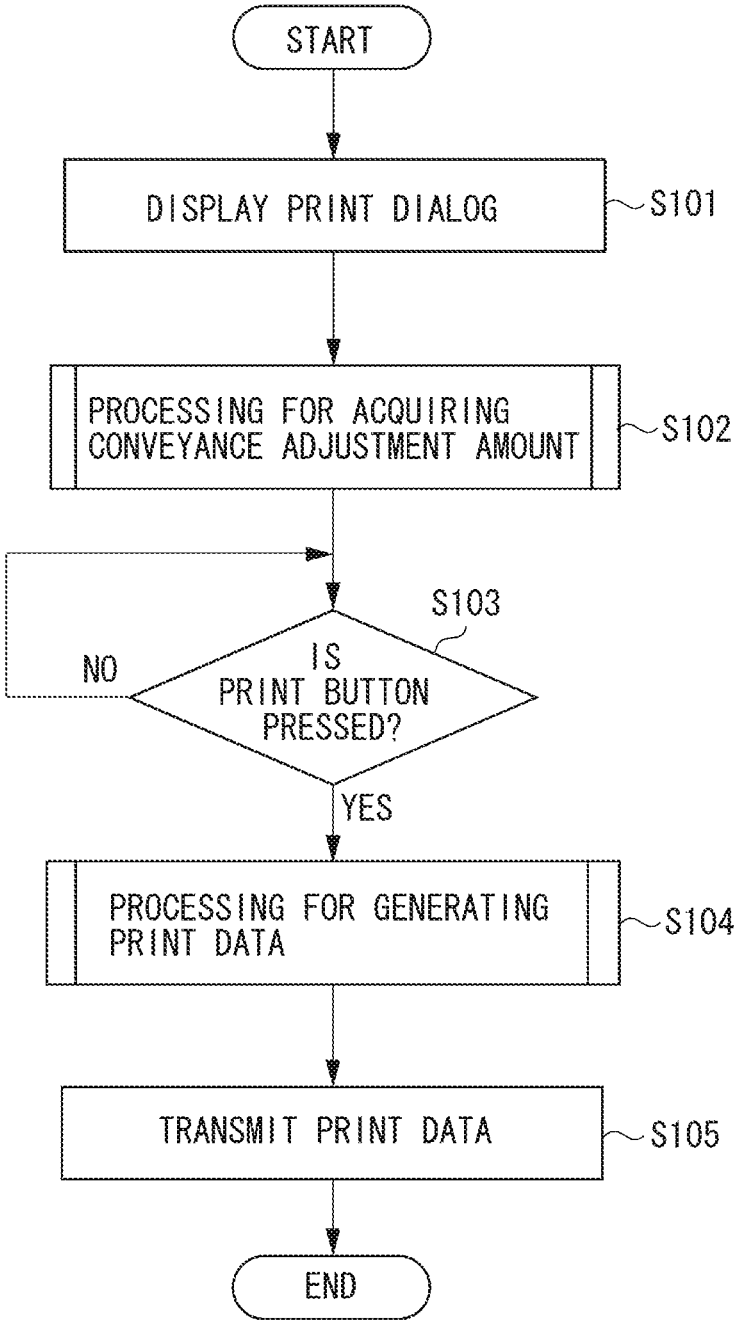
FIG. 6 is a flow chart illustrating print data transmission processing according to the exemplary embodiment.

Here, description returns to the processing for transmitting print data in FIG. 6. In step S103, it is determined whether the print button 305 is pressed. If the print button 305 is pressed (YES in step S103), the processing proceeds to step S104. In step S104, the processing for generating print data is executed based on the contents set by the printer driver and the acquired conveyance adjustment amount. In step S105, the host apparatus 1 transmits the print data generated by the host apparatus 1 in step S104 to the printer 2.

Figure 8:
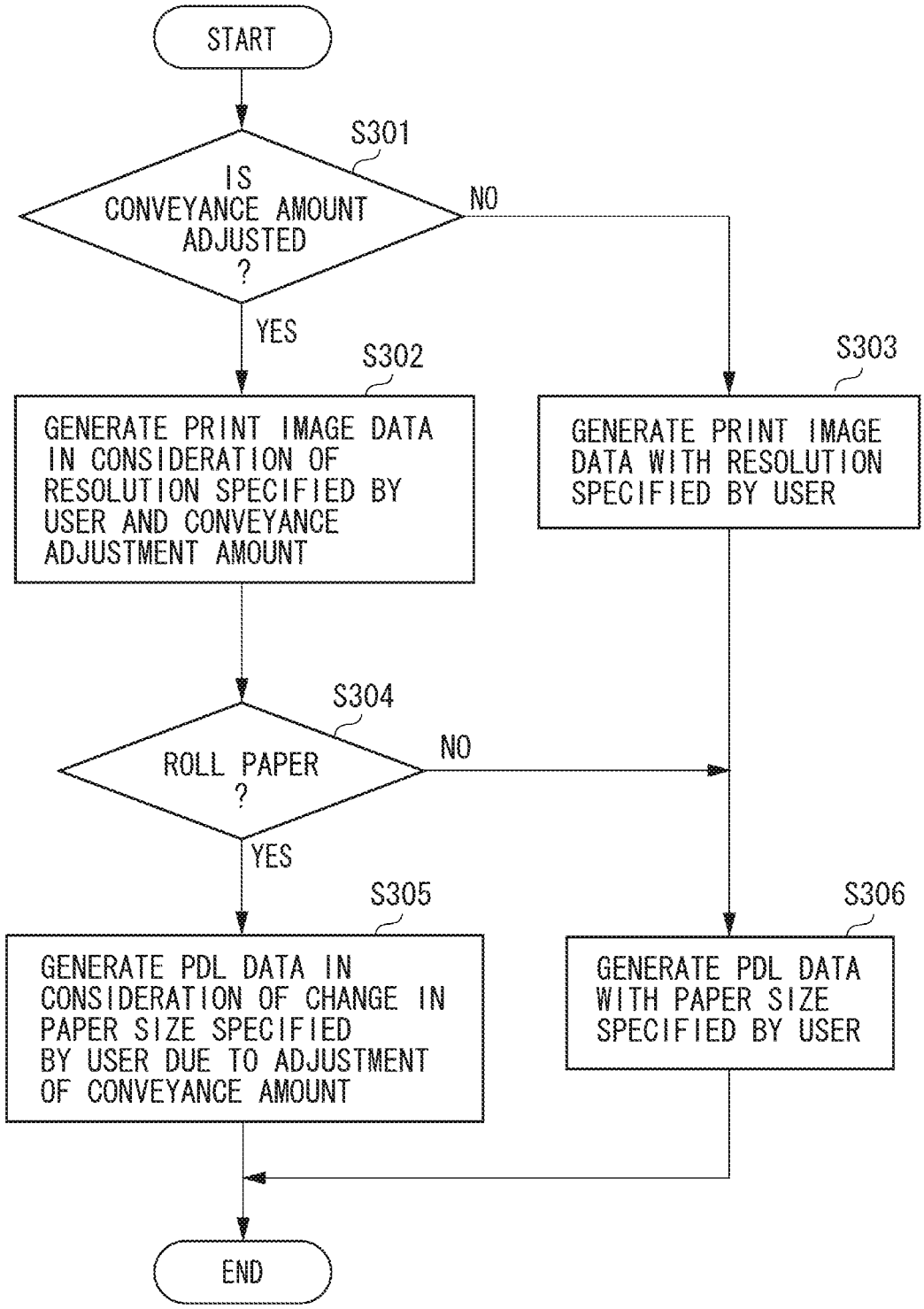
FIG. 8 is a flow chart illustrating processing for generating print data according to the exemplary embodiment.

FIG. 8 is a flow chart illustrating processing for generating print data in step S104. In step S301, it is determined whether a conveyance amount is to be adjusted in printing based on the conveyance adjustment amount acquired from the printer 2. In other words, in the present exemplary embodiment, the conveyance amounts of all the print media are not always adjusted and the conveyance adjustment amount may be zero depending on the type of a print medium. If it is determined that the conveyance amount is to be adjusted (YES in step S301), the processing proceeds to step S302. If it is determined that the conveyance amount is not to be adjusted (NO in step S301), the processing proceeds to step S303.

In step S302, the graphics processing unit 105 generates print image data (image data) based on the resolution associated with print quality and the acquired conveyance adjustment amount.

There is described below the generation of the print image data in a case where the conveyance amount is made greater by the conveyance adjustment amount than the standard conveyance amount. For example, in a case where the resolution associated with print quality is 600 dots per inch (DPI)×600 (DPI) and information about the conveyance adjustment amount is "increase of the number of pulses/adjustment interval 200," the conveyance amount in the direction of conveyance is greater by 1/200 than a case where the conveyance amount is not adjusted. Therefore, the resolution in the longitudinal direction (in the conveyance direction) of image data is generated by the resolution calculated by the following equation (1). More specifically, if the conveyance amount is increased by adjusting the conveyance amount, the resolution of image data in the conveyance direction is taken as the resolution lower than that set by the printer driver 103. Then, resolution information included in attribute data of the image data, which has been lowered in resolution as 600 DPI×597.0 DPI, is made to indicate a resolution of 600 DPI×600 DPI, which is the resolution before being lowered. The image data including the attribute data is transmitted to the printer 2. The printer 2 adjusts the print range in the conveyance direction so that the print range becomes equal to the length corresponding to the document size specified by the drive UI illustrated in FIG. 3 as described below.

$$600\ (\text{DPI})\times 200/201 = 597.0\ (\text{DPI}) \quad (1)$$

In step S304, it is determined whether the paper feeding method specified by the paper feeding method list box 303 is roll paper. If it is determined that the paper feeding method is roll paper (YES in step S304), the processing proceeds to step S305. If not (NO in step S304), the processing proceeds to step S306.

In step S305, output paper-size information of attribute data in the image data is adjusted in consideration of a change in the output paper size due to the adjustment of the conveyance amount and then the PDL data (print data) is generated. The printer 2 in the present exemplary embodiment controls the total conveyance amount using the same conveyance amount per one time as that in the case where the conveyance amount is not adjusted even if the conveyance amount is adjusted. For this reason, the adjustment of the conveyance amount causes the total conveyance amount managed by the printer 2 to deviate from the conveyance amount owing to actual conveyance. The cutter unit 229 determines the cut position of the print medium according to the output paper size included in the attribute data of the image data and the conveyance amount registered in the ROM 204. As a result, when print is performed on the print medium of the roll paper, the cut position after an image is printed is different from the position of the specified output paper size. In the present exemplary embodiment, when the conveyance amount is adjusted by the printer 2, the size of the print medium on which an image is actually printed is caused to agree with the specified paper size by changing the size corresponding to the direction in which the print medium with the output paper size included in the attribute data of the image data is conveyed, based on the conveyance adjustment amount.

For example, it is supposed that the contents set by the printer driver 103 are "A0 (841 mm×1189 mm)" and the resolution associated with the print quality is "600 (DPI)×600 (DPI)." It is also supposed that information about the conveyance adjustment amount acquired from the printer 2 is "increase of the number of pulses/adjustment interval 200." In this example, the size in the longitudinal direction of the output paper specified from the host apparatus 1 to the printer 2, in other words, the size information in the longitudinal direction of the output paper included in the attribute data of the image data, with respect to the output paper size specified as "A0 (841 mm×1189 mm)" is recalculated by the following equation (2). Information about the output paper size included in the attribute data of the image data is taken as 841 mm×1183 mm. As described above, the size information in the longitudinal direction of the output paper is made smaller to perform printing in the output paper size specified by the user even if the conveyance amount is adjusted by the printer 2.

$$1189\ (\text{mm})\times 200/201=1183.0\ (\text{mm}) \tag{2}$$

An example is supplementarily described below in which the conveyance amount is adjusted to reduce the conveyance amount. For example, it is supposed that the resolution associated with the print quality is "600 (DPI)×600 (DPI)" and information about the conveyance adjustment amount is "increase of the number of pulses/adjustment interval 200." In this case, the conveyance amount in the direction of conveyance is smaller by 1/200 than a case where the conveyance amount is not adjusted, so that image data is generated in the resolution in the longitudinal direction (the conveyance direction) calculated from the following equation (3) in step S302.

$$600\ (\text{DPI})\times 200/199=603.0\ (\text{DPI}) \tag{3}$$

In step S305, if the output paper size specified by the user is "A0 (841 mm×1189 mm)," the size in the longitudinal direction of the output paper specified from the host apparatus 1 to the printer 2, in other words, the size information in the longitudinal direction of the output paper included in the attribute data of the image data, is recalculated by the following equation (4).

$$1189\ (\text{mm})\times 200/199=1195.0\ (\text{mm}) \tag{4}$$

Also, in this case, resolution information included in the attribute data of the image data is taken as 600 (DPI)×600 (DPI) being the original resolution. Output paper size information is taken as 841 (mm)×1195 (mm) calculated above.

Here, description returns to the flow chart in FIG. 8. If it is determined that the conveyance amount is not to be adjusted (NO in step S301), the processing proceeds to step S303. In step S303, image data is generated in the resolution set by the printer driver 103. In step S306, it is determined that the conveyance amount is not to be adjusted or the print medium is not roll paper but cut paper. For this reason, print data (PDL data) is generated in the specified output paper size without recalculating the output paper size included in the attribute data of the image data based on the conveyance adjustment amount.

Figure 4A:
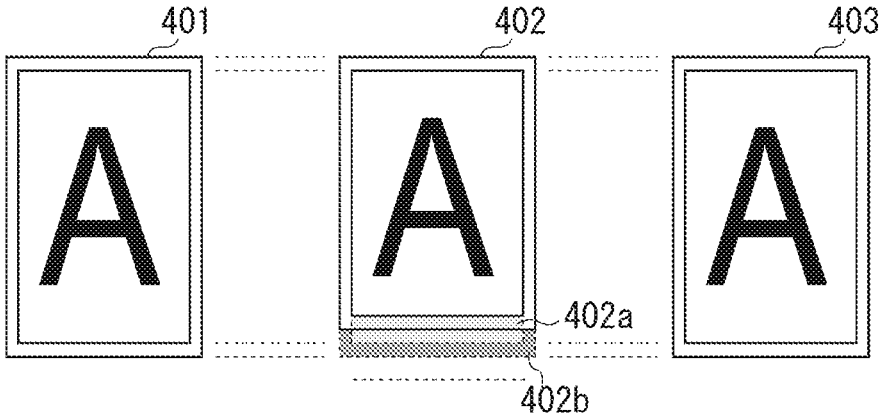
FIGS. 4A, 4B, and 4C are diagrams illustrating print data generation processing for increasing conveyance amounts.
Figure 4B:
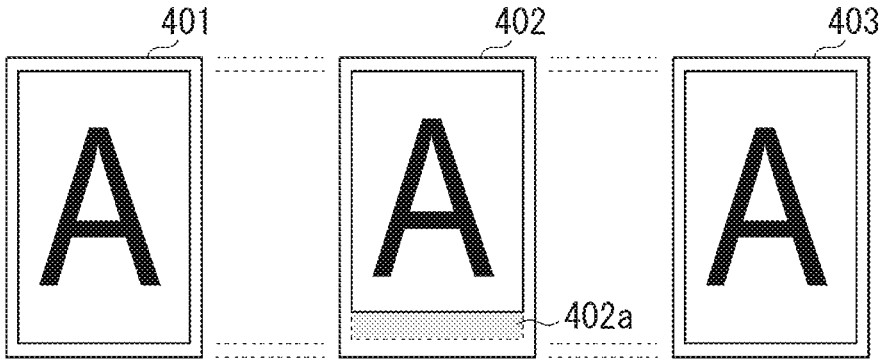
Figure 4C:
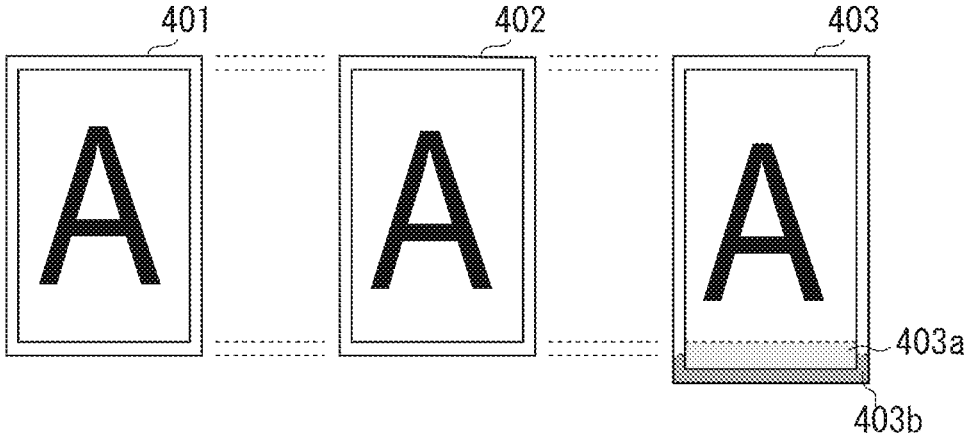

FIGS. 4A, 4B, and 4C illustrate schematically user generation data 401, print data (PDL data) 402, and an actual print result 403 in a case where the printer 2 performs the conveyance amount adjustment to increase the conveyance amount. FIG. 4A illustrates an example in which an image is printed on the print medium of roll paper according to the present exemplary embodiment. FIG. 4B illustrates an example in which an image is printed on the print medium of cut paper according to the present exemplary embodiment. FIG. 4C illustrates a conventional example in which an image is printed on the print medium of roll paper. The user generation data 401 is the one that is generated by the user using the application 102. The print data (PDL data) 402 is the one that is generated in steps S305 and S306 for generating print data in FIG. 8.

In FIG. 4A, the resolution in the conveyance direction of the print image data is made lower than that in the user generation data 401 in step S302 of FIG. 8 to decrease the number of pixels. In step S305, the size information in the conveyance direction of the output paper size included in the attribute data of the image data is changed to a size smaller than a specified size corresponding to an increase in the conveyance adjustment amount of the printer 2. The above processing produces a print image decrease 402*a* and an output paper size decrease 402*b* in the print data 402. In the present exemplary embodiment, the print data 402 is generated by reducing the output paper size included in the attribute data of the print image data and the image data in the conveyance direction, thereby acquiring the print result 403 as is the case with that of the user generation data 401 even in a case where the printer 2 performs adjustment for increasing the conveyance amount. More specifically, the print image data is reduced to perform printing as is the case with the user generation data 401 and the output paper size information of the attribute data of the image data is reduced to perform cutting in a position of the output paper size specified by the user generation data 401, thereby acquiring the print result 403.

In FIG. 4B, the resolution in the conveyance direction of the print image data is made lower than that in the user generation data 401 in step S302 of FIG. 8 to reduce the number of pixels. Since the print medium is cut paper, print data is generated with the specified size (step S306). The above processing produces the print image decrease 402*a* in the print data 402. In the present exemplary embodiment, the print data 402 is generated by reducing the print image data in the conveyance direction, thereby acquiring the print result 403 as is the case with that of the user generation data 401 even in a case where the printer 2 performs the conveyance amount adjustment for increasing the conveyance amount.

FIG. 4C illustrates a conventional configuration in which the print data 402 is generated without changing the size of the user generation data 401 and printing is performed on the roll paper based on the print data 402. The above configuration produces a print range increase 403*a* and a paper increase 403*b*. For this reason, the image to be printed does not fall within the predetermined range, or a margin to be left is reduced. According to the present exemplary embodiment, as illustrated in FIGS. 4A and 4B, an image to be printed can be prevented from exceeding the range of a print medium.

Figure 5A:
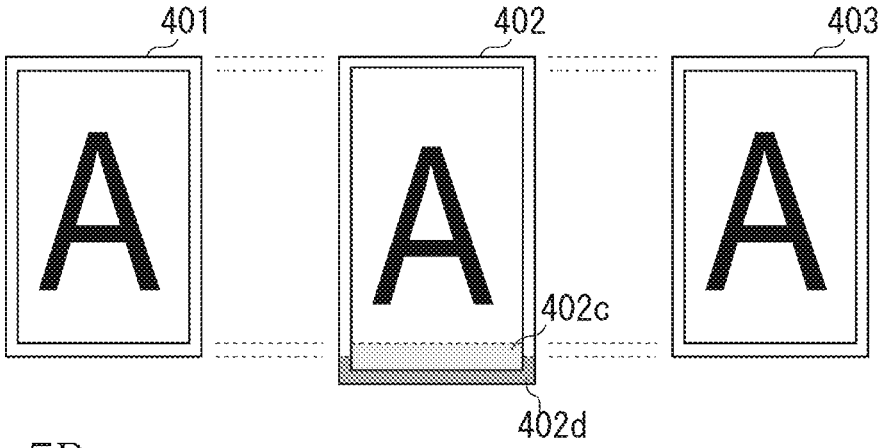
FIGS. 5A, 5B, and 5C are diagrams illustrating print data generation processing for decreasing conveyance amounts.
Figure 5B:
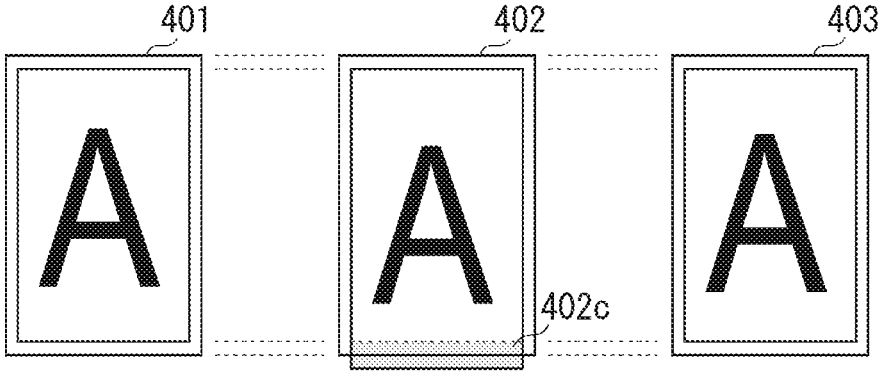
Figure 5C:
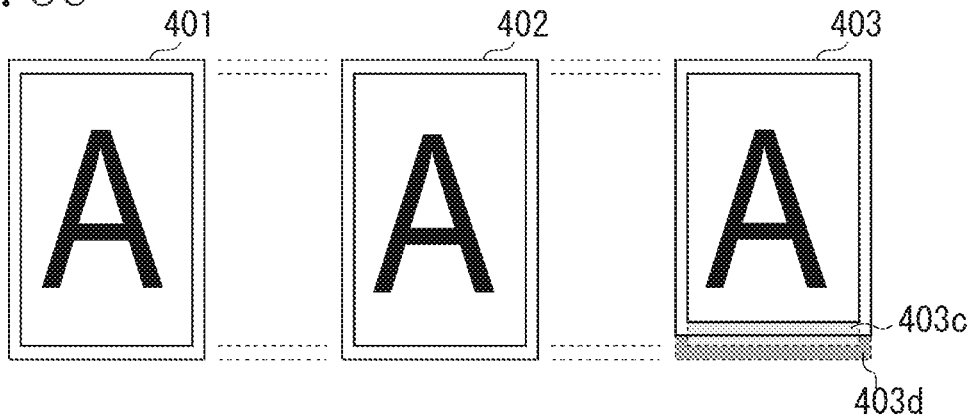

FIGS. 5A, 5B, and 5C illustrate schematically user generation data 401, print data (PDL data) 402, and an actual print result 403 in a case where the printer 2 performs the conveyance amount adjustment to decrease the conveyance amount. FIG. 5A illustrates an example in which an image is printed on the print medium of roll paper according to the present exemplary embodiment. FIG. 5B illustrates an example in which an image is printed on the print medium of cut paper according to the present exemplary embodiment. FIG. 5C illustrates a conventional example in which an image is printed on the print medium of roll paper.

In FIG. 5A, the resolution in the conveyance direction of the print image data is made higher than that in the user generation data 401 in step S302 of FIG. 8 to increase the number of pixels. In step S305, the size information of the output paper size included in the attribute data of the image data is changed to a size larger than a specified size corresponding to a decrease in the conveyance adjustment amount of the printer 2. The above processing produces a print image increase 402*c* and an output paper size increase 402*d* in the print data 402. In the present exemplary embodiment, the print data 402 is generated by increasing the output paper size included in the attribute data of the print image data and the image data in the conveyance direction, thereby acquiring the print result 403 as is the case with that of the user generation data 401 even in a case where the printer 2 performs adjustment for decreasing the conveyance amount. More specifically, the print image data is increased to perform printing as is the case with the user generation data 401 and the output paper size information of the attribute data of the image data is increased to perform cutting in a position of the output paper size specified by the user generation data 401, thereby acquiring the print result 403.

In FIG. 5B, the resolution in the conveyance direction of the print image data is made higher than that in the user generation data 401 in step S302 of FIG. 8 to increase the number of pixels. Since the print medium is cut paper, print data is generated with the specified size (step S306). The above processing produces the print image increase 402*c* in the print data 402. In the present exemplary embodiment, the print data 402 is generated by increasing the print image data in the conveyance direction, thereby acquiring the print result 403 as is the case with that of the user generation data 401 even in a case where the printer 2 performs the conveyance amount adjustment for decreasing the conveyance amount.

FIG. 5C illustrates a conventional configuration in which the print data 402 is generated without changing the size of the user generation data 401 and printing is performed on the roll paper based on the print data 402. The above configuration produces a print range decrease 403*c* and a paper decrease 403*d*. For this reason, the image to be printed is reduced in the conveyance direction to leave a large margin at the trailing edge of the print medium. According to the present exemplary embodiment, as illustrated in FIGS. 5A and 5B, a useless margin can be prevented from being left in the predetermined range.

In the description of the above exemplary embodiment, the conveyance adjustment amounts are stored in the ROM 204 of the printer 2. However, the conveyance adjustment amounts may be stored in the ROM 112 of the host apparatus 1, for example. Furthermore, the conveyance adjustment amount do not need to be set for each of all types of print media used by the printer 2 and the conveyance adjustment amount may be set for a part of types of print media.

In the above exemplary embodiment, the resolution in the longitudinal direction (the conveyance direction) is changed according to the conveyance adjustment amount. However, the resolution also in the transverse direction (the scanning direction of the print head) may also be changed to conform to the changed resolution in the longitudinal direction. In the above exemplary embodiment, the resolution of the print image data is changed. However, a change in size of the image data is not limited to this, and the print image data may be enlarged or reduced.

In the description of the above exemplary embodiment, the host apparatus 1 acquires the conveyance adjustment amount from the printer 2 and changes the output paper size included in the attribute data of the print image data and the image data based on the conveyance adjustment amount. Such processing may be performed by the printer 2. More specifically, when the host apparatus 1 receives the print data generated based on the user generation data, the printer 2 acquires the conveyance adjustment amount from the ROM based on the type of a print medium prescribed in the print data. The printer 2 changes the output paper size included in the attribute data of the print image data of the print data and the image data based on the conveyance adjustment amount to generate new print data and performs printing based on the generated print data. Thus, the processing for generating the print data in the above exemplary embodiment is not limited to the processing by the host apparatus 1, but may be performed at the processing by the printer 2.

In the above exemplary embodiment, the cutter unit 229 determines the cut position of the print medium according to the output paper size included in the attribute data of the image data and the conveyance adjustment amount stored in the ROM 204. However, the present invention is not limited to the above exemplary embodiment. For example, if the size corresponding to the conveyance direction of the print medium for the image data is changed, the cutter unit 229 may determine the cut position of the print medium according to only the output paper size included in the attribute data of the image data without considering the conveyance adjustment amount stored in the ROM 204.

In the above exemplary embodiment, the present invention is described using the printing method in which the print head of the printer is moved in the main scanning direction and the print medium is moved in the sub-scanning direction orthogonal to the main scanning direction every time the print head scans once. However, the present invention is not limited to the above exemplary embodiment. The present invention can also be applied to a printing method in which the print head of the printer is moved in the main scanning direction and moved in the sub-scanning direction after the print head scans once, for example, in other words, a printing method in which only the print head is moved with the print medium fixed. In this case, the host apparatus 1 may acquire the adjustment amount of the movement amount in the sub-scanning direction of the print head of the printer 2 to change the size corresponding to the sub-scanning direction of the print medium for the image data according to the acquired movement amount.

In the present exemplary embodiment, an ink jet printer is taken as an example. However, the application of the present invention is not limited to that example. The present invention can also be applied to a printer using solid ink as recording agent, for example, and to various types of printers, such as an electrophotographic printer using toner and a sublimation printer.

The present exemplary embodiment can also be applied to a printing system composed of an external apparatus (a host apparatus) and a printing apparatus (a printer), with the external apparatus and the printing apparatus sharing print data generation processing. The present exemplary embodiment can be realized by program code including a computer readable program for realizing functions of the above print data generation processing or by a storage medium storing the program code. In this case, a computer (or a CPU or an MPU) or a plurality of computers of a host apparatus and a printing apparatus collaborates with one another, reads and executes the above program code to realize the above processing. Thus, a program that can be read by a computer and that causes the computer to execute the above processing or a storage medium storing the program is also included in an exemplary embodiment of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-129156 filed Jun. 9, 2011, which is hereby incorporated by reference herein in its entirety.

What is claimed is:

1. An apparatus for generating image data used for printing an image on a print medium by using a printing apparatus, the apparatus comprising:

an acquisition unit configured to acquire, in a case where the printing apparatus adjusts a conveyance amount by increasing or decreasing a conveyance amount of the print medium with respect to a standard conveyance amount for printing image data with a specified size, an adjustment amount of the conveyance amount of the print medium; and a generating unit configured to generate the image data used for printing according to the adjustment amount acquired by the acquisition unit, wherein a size of the generated image data in a conveyance direction of the print medium is different from the specified size.

2. The apparatus according to claim 1, wherein the generating unit generates the image data by changing a resolution of the image data in the conveyance direction.

3. The apparatus according to claim 1, wherein the printing apparatus includes a cutting unit configured to cut the print medium based on a size of the print medium and the adjustment amount which are specified by the apparatus, and wherein the generating unit changes size information of the print medium included in attribute data of the image data corresponding to the conveyance direction such that the size in the conveyance direction of the print medium cut by the cutting unit becomes equal to the specified size of the print medium.

4. The apparatus according to claim 1, wherein the adjustment amount is set for each type of the print medium on which the printing apparatus prints an image.

5. The apparatus according to claim 1, wherein the printing apparatus is configured to print an image with a print head scanning the print medium, and wherein the adjustment amount is applied to a conveyance amount for each scan of the print head.

6. The apparatus according to claim 1, wherein the generating unit generates the image data so as to reduce print data to be smaller than the specified size in a case where the conveyance amount increases, and enlarge print data to be larger than the specified size in a case where the conveyance amount decreases.

7. A method for generating image data used for printing an image on a print medium by using a printing apparatus, the method comprising:

acquiring, in a case where the printing apparatus adjusts a conveyance amount by increasing or decreasing a conveyance amount of the print medium with respect to a standard conveyance amount for printing image data with a specified size, an adjustment amount of the conveyance amount of the print medium; and generating the image data used for printing according to the acquired adjustment amount, wherein a size of the generated image data in a conveyance direction of the print medium is different from the specified size.

8. The method according to claim 7, wherein the image data generated according to the adjustment amount is generated by changing a resolution of the image data in the conveyance direction.

9. The method according to claim 7, wherein size information of the print medium included in attribute data of the image data is changed corresponding to the conveyance direction such that the size in the conveyance direction of the print medium cut by a cutting unit of the printing apparatus becomes equal to the specified size of the print medium.

10. The method according to claim 7, wherein the adjustment amount is set for each type of the print medium on which the printing apparatus prints an image.

11. The method according to claim 7, wherein the printing apparatus is configured to print an image with a print head scanning the print medium, and wherein the adjustment amount is applied to a conveyance amount for each scan of the print head.

12. A non-transitory computer-readable storage medium storing a computer-executable program for performing a method for generating image data used for printing an image on a print medium by using a printing apparatus, the program comprising:

acquiring, in a case where the printing apparatus adjusts a conveyance amount by increasing or decreasing a conveyance amount of the print medium with respect to a standard conveyance amount for printing image data with a specified size, an adjustment amount of the conveyance amount of the print medium; and generating the image data used for printing according to the acquired adjustment amount, wherein a size of the generated image data in a conveyance direction of the print medium is different from the specified size.

* * * * *